United States Patent [19]

Fahrbach et al.

[11] 4,259,390

[45] Mar. 31, 1981

[54] NONWOVEN FABRIC HAVING THE APPEARANCE OF A WOVEN FABRIC

[75] Inventors: Erich Fahrbach; Adolf Gräber; Jürgen Knoke, all of Weinheim an der Bergstrasse; Helmer Schweizer, Hirschberg; Bohuslav Tecl, Weinheim an der Bergstrasse, all of Fed. Rep. of Germany

[73] Assignee: Firma Carl Freudenberg, Weinheim, Fed. Rep. of Germany

[21] Appl. No.: 951,945

[22] Filed: Oct. 16, 1978

[30] Foreign Application Priority Data

Nov. 26, 1977 [DE] Fed. Rep. of Germany ..... 2752935

[51] Int. Cl.[3] ..... B32B 27/14

[52] U.S. Cl. ..... 428/195; 428/198; 428/207; 428/296

[58] Field of Search ..... 428/195, 198, 207, 152, 428/296

[56] References Cited

U.S. PATENT DOCUMENTS

| | | | |
|---|---|---|---|
| 1,992,215 | 2/1935 | Kellett | 428/154 |
| 3,047,445 | 7/1962 | Gresham | 428/154 |
| 3,542,634 | 11/1970 | Such et al. | 428/198 |
| 3,672,950 | 6/1972 | Murphy et al. | 428/154 |
| 3,708,366 | 1/1973 | Donnelly | 428/154 |
| 3,738,905 | 6/1973 | Thomas | 428/154 |
| 3,914,493 | 10/1975 | Gräber | 428/198 |

*Primary Examiner*—George F. Lesmes
*Assistant Examiner*—E. Rollins Buffalow
*Attorney, Agent, or Firm*—Sprung, Felfe, Horn, Lynch & Kramer

[57] ABSTRACT

A nonwoven fabric having the appearance of a woven fabric and suited for use as a lining material for garments, comprising a nonwoven fabric substrate embossed on its face in a regular pattern of discrete areas of a maximum diameter of about 0.45 mm spaced not more than about 1.0 mm apart and carrying thereon in a regular printed pattern discrete areas of bonding-agent of a maximum diameter of about 0.45 mm spaced not more than about 0.7 mm apart. Advantageously the bonding-agent contains a coloring additive which differentiates it from the color of the nonwoven fabric, the spacing of the areas of the bonding-agent printed pattern is from about 50 to 95% of the spacing of the areas of the embossed pattern, the areas of the embossed and printed patterns are rectangular, the lengths of their lateral edges corresponding to a ratio of about 2:3, the sum of the length and width not exceeding a value of about 0.9 mm, and the areas of the embossed and printed patterns are arranged in straight lines parallel and at right angles to the longitudinal direction, and the areas within the lines of the embossed pattern and within the lines of the printed pattern are evenly spaced. The underside of the fabric may carry an adhesive by means of which it may be bonded to the underside of an outer fabric as a lining therefor.

11 Claims, No Drawings

NONWOVEN FABRIC HAVING THE APPEARANCE OF A WOVEN FABRIC

The invention relates to a nonwoven fabric having the appearance of a woven fabric, in particular for use as a lining material for garments.

German Pat. No. 1,635,577 discloses a method of producing a woven-fabriclike structure in a nonwoven fabric by means of gas or water jets directed against its surface. As in a mechanical needling operation, a perforation of the nonwoven fabric then occurs, and at the same time a reciprocal enwrapment of the fibers surrounding the holes so produced. In its appearance and properties, the resulting product resembles a woven fabric very much. However, it has no shape-retaining properties and therefore is not suited for use as a lining.

Besides, in textiles of this type, as in woven fabrics, the drapability is dependent on the direction, and if they were to be used as linings the course of the perforations would have to be carefully matched to the cut. A high percentage of unusable edge portions and other cutting waste would be unavoidable.

Another drawback which the use of open-meshed textiles as lining maerials entails is that they have very little abrasion resistance in the surface region so that even after slight use there will be pronounced peeling of individual fibers and pilling. Moreover, the open-meshed structure necessitates a specific distribution of any adhesive disposed on the underside. If the distribution is regular, this may entail drawbacks with regard to the surface of the lined material; and moire patterns, for example, are highly undesirable.

Also known are lining materials consisting of an isotropic nonwoven fabric on whose surface an adhesive is disposed in statistical distribution. Without breathing impairment, an excellent bond to the face fabric is thus assured and moiré effects are positively avoided. However, the inside of garments so constructed often looks too plain to meet the exacting requirements of fashion. For this reason, additional secondary inner liners have frequently been used.

The object of the invention is to develop a drapable lining material which has high abrasion resistance and uniform shape-retaining properties in all directions, and whose surface has the appearance of a woven fabric regardless of the direction in which it is viewed.

This object is accomplished in the case of a nonwoven fabric of the type mentioned above in that with a homogeneous structure it has on its face a regular embossed pattern of discrete areas of a maximum diameter of about 0.45 mm spaced not more than about 1.0 mm apart on which a regular bonding-agent printed pattern of discrete areas of a maximum diameter of about 0.45 mm spaced not more than about 0.7 mm apart is superimposed. The specification concerning the diameter of the areas applies in each case to the largest linear extension of the areas. When the areas are rectangular, for example, it applies to the length of the diagonal.

The spacing relates to the spacing of the lateral edges of the areas from one another, not to the center-to-center spacing. In the case of a statistical distribution of the areas, which, however, is not preferred within the meaning of the invention, adjacent area means one whose lateral edge is located not farther than 1.5 mm from the lateral edge of the original area. Preferred within the meaning of the invention is a regular geometrical distribution with the areas evenly spaced apart.

The embossed and bonding-agent printed dots are preferably arranged in rows parallel or at right angles to the direction of motion. This will come closest to creating the external appearance of a woven fabric. However, the rows may also be disposed at any desired angle to the direction of motion. A statistical arrangement of the embossed and bonding-agent printed dots is also possible, and in this case the average spacing of one dot from the next should be as specified above. In the preferred arrangement of rows parallel or at right angles to the direction of motion, the dot-to-dot spacing may be kept constant in both directions, or the spacing may be less in one direction than in the other; but in no case should the spacing be greater than as specified above.

Through the reciprocal superimposition of the embossed pattern and the printed pattern, an optical effect is obtained which approaches the appearance of a woven fabric very closely.

Of particular importance is in addition that the small amount of bonding agent imprinted on the surface of the nonwoven fabric results in an extraordinary improvement of the abrasion resistance without measurably impairing the drapability. In accordance with a special variant, it is contemplated to add coloring matter to the bonding agent to differentiate it from the color of the nonwoven fabric. Surprisingly, it has been found that the nature of the coloring addition is of little consequence; yellow tints or dark-brown tints may be used with equally good results. The choice is a matter of taste and will be up to the user. For the purposes of the present invention, protection is merely claimed for the fact that the bonding-agent imprint generally contains a coloring additive. Surprisingly, the addition of coloring matter produces, in conjunction with the other characteristics called for, the optical effect of a three-dimensional woven-fabric structure. This effect could not have been foreseen since the embossed areas and the imprinted areas are not coordinated with each other in a continuous, constant correlation. In fact, it has been found to be particularly advantageous for the areas of the embossed pattern to be spaced farther apart than the areas of the bonding-agent printed pattern. It has been found particularly advantageous for the spacing of the areas of the bonding-agent printed pattern to be from 50 to 95% of the spacing of the areas of the embossed pattern. In the continuous manufacture of the nonwoven fabric in accordance with the invention, there is thus a continual variation of the correlation of the individual areas, and while in one region imprinted areas may be located between the embossed areas, in another region they may completely overlap the embossed areas. In the nonwoven fabric in accordance with the invention, these irregularites surprisingly do not entail drawbacks with regard to the optical appearance of the surface of the nonwoven fabric but actually enhance, in a particularly advantageous manner, the impression of a woven-fabric structure. The latter may, if desired, be extended to both sides of the nonwoven fabric in accordance with the invention. In accordance with a special variant, it is contemplated that the areas forming the embossed pattern and the areas forming the bonding-agent printed pattern have the same form and/or size. It has further been found to be advantageous for the spacing of the areas of the embossed and printed patterns to be the same in the longitudinal and transverse directions.

The areas of the embossed and printed patterns may be circular, square, rectangular or ellipsoid or may be bounded in accordance with a combination of these forms.

The countless possibilities for variation resulting therefrom permit both the appearance and the mechanical strength of the surface of the nonwoven fabric in accordance with the invention to be considerably modified, particularly with regard to its use as a lining material. The appearance of the nonwoven fabric may therefore be adapted to multifarious fashion trends, and it may be used to assemble better outer garments without being covered by secondary lining materials. The nonwoven fabric has high breathing capability. This results in an additional improvement in wearing comfort particularly when outer garments are so lined.

The use of rectangularly shaped areas in the formation of the embossed and printing patterns has proved advantageous when the nonwoven fabric in accordance with the invention is to be used as a lining material for heavy face fabrics. The lengths of the lateral edges with an appropriate choice of areas then corresponds advantageously to a ratio of about 2:3; and the sum of the length and width of each such area should not then exceed a value of about 0.9 mm. Thus the areas which are used in accordance with the invention have in every case a very fine structure. The embossed areas are advantageously spaced not less than 0.5 mm apart, and the printed areas not less than 0.4 mm. In this way, the surprising result is obtained that the nonwoven fabric in accordance with the invention can be used largely independently of direction without this entailing an impairment of the woven-fabriclike appearance. This results in substantial advantages particularly when such a nonwoven fabric is used as a lining material since the individual cuts can then be selected practically at random from the area of the nonwoven-fabric web.

A further advantage is that the actually closed structure of the nonwoven fabric in accordance with the invention permits a completely neutral distribution of the adhesive which in accordance with a special variant may be disposed on its underside. The adhesive is appropriately applied to the underside of the nonwoven fabric in discrete areas in a regular or irregular geometrical or possibly statistical distribution. This permits the nonwoven fabric to be optimally adapted to widely differing specific requirements when it is used as a fixable liner. The adhesive used may be a PVC plastisol, polyamide or polyethylene, and it may be imprinted, dusted on or applied by the powder-dot method.

For the purposes of the present invention, a wide variety of nonwoven fabrics may be used; however, it is essential that they have largely direction-independent shape-retaining properties and be susceptible to being embossed. The nonwoven fabrics in accordance with the invention may thus be fortified with a bonding agent or with fibers, and such fortifying may be effected continuously with the embossing. Similarly, it is possible to provide a prefortified material subsequently with a fortification-independent embossment. The bonding agent is imprinted independently of the embossing operation. It has been found practical to effect such imprinting following the embossing.

The composition of the bonding agent chosen may also be varied; however, polyacrylates, polybutadiene-styrene or -acrylonitrile copolymers or polyurethanes are preferably used. Depending on the concentration of the bonding agent, it will penetrate into the nonwoven base fabric to a greater or less depth.

In the case of sewable lining materials, deeper penetration generally is preferred in order to impart to both sides of the nonwoven fabric the appearance of a woven fabric and to increase the abrasion resistance on both sides. In the case of fixable lining materials, on the other hand, less penetration of the bonding agent is desired with a view to suppressing an unavoidable harshening of the hand.

The following example illustrates the production of the novel fabric:

EXAMPLE

From a blend of 60% polyethylene terephthalate fibers, 1.7 dtex, 40 mm, and 40% polybutylene terephthalate fibers, 1.6 dtex, 40 mm, a nonwoven fabric of 40 g/m$^2$ was formed by the use of a card and a cross-layer. The nonwoven fabric was immediately fed to an embossing calendar consisting of a smooth steel roll and of an engraved steel roll and was thermally consolidated at a temperature of 210° C., a speed of 14 m/min and a line pressure of 30 kp/cm. The rolls of the embossing calender had a diameter of 150 mm. The surface of the engraved steel roll had evenly distributed elevations with a top area of 0.3×0.3 mm and a height of 0.65 mm. The elevations were spaced 0.9 mm apart, measured from edge to edge in the transverse and longitudinal directions.

Following the consolidating operation, a colored bonding agent was applied to the surface of the nonwoven fabric by means of an 0.15-mm thick, 30-mesh printing screen. The bonding agent was a copolymer of polybutylacrylate, acrylonitrile and N-methylolacrylamide containing a polyacrylate thickener and a little coloring matter in the form of iron-oxide pigments. The nonwoven fabric then had a weight per unit area of 44 g/m$^2$.

A terpolymer composed of caprolactam, hexamethylenediammonium adipate salt and ω-laurolactam in the weight ratio of 1:1:2 was then imprinted on the back of the nonwoven fabric as a hot-setting polyamide adhesive in known manner by means of a 17-mesh screen by the silk-screen technique to give 14 grams of hot-setting adhesive per square meter.

The nonwoven fabric otained had on its face a high-grade, woven-fabriclike appearance. It could be ironed directly into outer garments, a special advantage being that the additional use of a secondary lining material was no longer necessary.

The inside of garments lined with the nonwoven fabric in accordance with the invention is appealing and tasteful.

While a completely regular size and arrangement of embossing and bonding-agent areas are preferred, they can be slightly randomized as shown in U.S. Pat. No. 3,914,493.

It will be appreciated that the instant specification and examples are set forth by way of illustration and not limitation, and that various modifications and changes may be made without departing from the spirit and scope of the present invention.

What is claimed is:

1. A nonwoven fabric having the appearance of a woven fabric, and suited for use as a lining material for garments, comprising a nonwoven fabric substrate embossed substantially over its entire face in a regular pattern of discrete areas of a maximum diameter of about 0.45 mm spaced not more than about 1.0 mm apart and carrying thereon substantially over its entire face in a regular printed pattern discrete colored areas of bonding agent of a maximum diameter of about 0.45 mm spaced not more than about 0.7 mm apart, the areas of the embossed pattern being spaced farther apart then the colored areas.

2. A nonwoven fabric according to claim 1, wherein the bonding-agent contains a coloring additive which differentiates it from the color of the nonwoven fabric.

3. A nonwoven fabric according to claim 1, wherein the areas forming the embossed pattern and the colored areas are of the same form or size.

4. A nonwoven fabric according to claim 1, wherein the spacing of the colored areas is from about 50 to 95% of the spacing of the areas of the embossed pattern.

5. A nonwoven fabric according to claim 1, wherein the areas of the embossed and colored patterns are arranged in straight lines parallel and at right angles to the longitudinal direction, and the areas within the lines of the embossed pattern and within the lines of the colored pattern are evenly spaced.

6. A nonwoven fabric according to claim 1, wherein the areas of the embossed and colored patterns are circular, square, rectangular or ellipsoidal.

7. A nonwoven fabric according to claim 1, wherein the areas of the embossed and colored patterns are rectangular, the lengths of their lateral edges corresponding to a ratio of about 2:3, the sum of the length and width not exceeding a value of about 0.9 mm.

8. A nonwoven fabric according to claim 1, including an adhesive on the face of the nonwoven substrate remote from the colored areas, whereby the fabric can be adhered to an outer fabric as a lining.

9. A nonwoven fabric according to claim 9, wherein the spacing of the areas colored is from about 50 to 95% of the spacing of the areas of the embossed pattern, the areas of the embossed and colored patterns are rectangular, the lengths of their lateral edges corresponding to a ratio of about 2:3, the sum of the length and width not exceeding a value of about 0.9 mm, and the areas of the embossed and colored patterns are arranged in straight lines parallel and at right angles to the longitudinal direction, and the areas within the lines of the embossed pattern and within the lines of the colored pattern are evenly spaced.

10. A garment including an outer fabric and, adhered thereto as a lining, a nonwoven fabric according to claim 1.

11. A garment including an outer fabric and, adhered thereto as a lining, a nonwoven fabric according to claim 9.

* * * * *

UNITED STATES PATENT AND TRADEMARK OFFICE

CERTIFICATE OF CORRECTION

PATENT NO. : 4,259,390

DATED : March 31, 1981

INVENTOR(S) : Erich Fahrback et al.

It is certified that error appears in the above-identified patent and that said Letters Patent are hereby corrected as shown below:

Patent

Col. 4, Line 44 "otained" should be "obtained"

Col. 6, Line 7 Claim 9 should refer to Claim 8.

Signed and Sealed this

Fourth Day of August 1981

[SEAL]

Attest:

GERALD J. MOSSINGHOFF

Attesting Officer

Commissioner of Patents and Trademarks